US008402585B2

(12) United States Patent
Rief et al.

(10) Patent No.: US 8,402,585 B2
(45) Date of Patent: Mar. 26, 2013

(54) CONVERTIBLE PRESSURE/SUCTION SWIMMING POOL CLEANER

(75) Inventors: Manuela Rief, Santa Rosa, CA (US); Dieter J. Rief, Santa Rosa, CA (US)

(73) Assignee: Poolvergnuegen, Santa Rosa, CA (US)

( * ) Notice: Subject to any disclaimer, the term of this patent is extended or adjusted under 35 U.S.C. 154(b) by 740 days.

(21) Appl. No.: 12/581,405

(22) Filed: Oct. 19, 2009

(65) Prior Publication Data

US 2011/0088181 A1 Apr. 21, 2011

(51) Int. Cl.
*E04H 4/16* (2006.01)

(52) U.S. Cl. ..... 15/1.7

(58) Field of Classification Search .. 15/1.7; *E04H 4/16*
See application file for complete search history.

(56) References Cited

U.S. PATENT DOCUMENTS

| | | | | |
|---|---|---|---|---|
| 3,822,754 | A * | 7/1974 | Henkin et al. | 180/7.1 |
| 3,936,899 | A * | 2/1976 | Henkin et al. | 15/1.7 |
| 3,972,339 | A * | 8/1976 | Henkin et al. | 134/168 R |
| 4,429,429 | A * | 2/1984 | Altschul | 15/50.1 |
| 4,434,519 | A * | 3/1984 | Raubenheimer | 15/1.7 |
| 4,558,479 | A * | 12/1985 | Greskovics et al. | 15/1.7 |
| 4,589,986 | A * | 5/1986 | Greskovics et al. | 210/483 |
| 4,656,683 | A * | 4/1987 | Raubenheimer | 15/1.7 |
| 4,920,599 | A * | 5/1990 | Rief | 15/1.7 |
| 5,033,148 | A | 7/1991 | Chauvier et al. | |
| 5,099,535 | A | 3/1992 | Chauvier et al. | |
| 5,802,653 | A | 9/1998 | Roumagnac | |
| 5,985,156 | A * | 11/1999 | Henkin et al. | 210/744 |
| 6,039,886 | A * | 3/2000 | Henkin et al. | 210/776 |
| 6,131,227 | A * | 10/2000 | Rief et al. | 15/1.7 |
| 6,187,181 | B1 | 2/2001 | Stoltz et al. | |
| 6,199,237 | B1 | 3/2001 | Budden | |
| 6,280,611 | B1 * | 8/2001 | Henkin et al. | 210/143 |
| 6,292,940 | B1 | 9/2001 | Sato | |
| 6,292,970 | B1 * | 9/2001 | Rief et al. | 15/1.7 |

(Continued)

FOREIGN PATENT DOCUMENTS

| | | | |
|---|---|---|---|
| FR | 2925557 | A1 * | 6/2009 |
| FR | 2929310 | A1 * | 10/2009 |

(Continued)

OTHER PUBLICATIONS

Excerpts of PCT International Search Report and Written Opinion for PCT/US2010/02359. 4 pages. Date: Nov. 2, 2010.

*Primary Examiner* — Phi Dieu Tran A
(74) *Attorney, Agent, or Firm* — Jansson Shupe & Munger Ltd.

(57) ABSTRACT

A swimming pool cleaner interchangeably usable as a suction cleaner and as a pressure cleaner. The cleaner is of the type movable along an underwater pool surface to clean debris therefrom, the pool cleaner including a body having a debris inlet and a debris outlet. The body is adapted at the debris outlet for securement of either a water-suction hose connected to a remote suction system or a debris-collection device entrapping debris and passing water therethrough back into the pool. A venturi-line structure is secured with respect to the body. The venturi-line structure includes a venturi-line inlet adapted for connection of a water-flow line fed by a remote pump and a venturi jet located at the debris inlet to cause accelerated flow substantially thereacross and into the body when the cleaner is used as a pressure cleaner. The body includes a debris-inlet adjuster configured to reduce the debris inlet to adapt the cleaner for use as a suction cleaner.

20 Claims, 7 Drawing Sheets

U.S. PATENT DOCUMENTS

| | | | | |
|---|---|---|---|---|
| 6,409,916 | B1 * | 6/2002 | Zelas et al. | 210/167.16 |
| 6,473,928 | B1 * | 11/2002 | Veloskey et al. | 15/1.7 |
| RE38,479 | E * | 3/2004 | Henkin et al. | 210/103 |
| 6,733,046 | B1 | 5/2004 | Rief | |
| 6,782,578 | B1 * | 8/2004 | Rief et al. | 15/1.7 |
| 6,854,148 | B1 * | 2/2005 | Rief et al. | 15/1.7 |
| 7,080,424 | B2 * | 7/2006 | Kallenbach et al. | 15/1.7 |
| 7,168,120 | B2 | 1/2007 | Habif et al. | |
| 7,316,751 | B2 | 1/2008 | Horvath et al. | |
| 7,677,268 | B2 * | 3/2010 | Griffin et al. | 137/624.14 |
| 7,805,792 | B2 * | 10/2010 | Roumagnac | 15/1.7 |
| 7,827,643 | B2 * | 11/2010 | Erlich et al. | 15/1.7 |
| 7,867,389 | B2 * | 1/2011 | Hui | 210/167.16 |
| 7,908,696 | B2 * | 3/2011 | Pareti | 15/1.7 |
| 2003/0106174 | A1 * | 6/2003 | Kallenbach et al. | 15/1.7 |
| 2003/0182742 | A1 * | 10/2003 | Wichmann et al. | 15/1.7 |
| 2004/0010867 | A1 | 1/2004 | Habif et al. | |
| 2005/0108836 | A1 * | 5/2005 | Rowan et al. | 15/1.7 |
| 2006/0042688 | A1 * | 3/2006 | Sebor | 137/114 |
| 2006/0254004 | A1 | 11/2006 | Fraenkel | |
| 2007/0107148 | A1 | 5/2007 | Rowan et al. | |
| 2007/0289075 | A1 * | 12/2007 | Gopalan | 15/1.7 |
| 2007/0289906 | A1 * | 12/2007 | Gopalan | 210/121 |

FOREIGN PATENT DOCUMENTS

| | | | |
|---|---|---|---|
| WO | WO 2008096323 | A2 * | 8/2008 |
| WO | WO 2008102325 | A1 * | 8/2008 |

* cited by examiner

CONVERTIBLE PRESSURE/SUCTION SWIMMING POOL CLEANER

FIELD OF THE INVENTION

The present invention relates to swimming pool cleaners and, more particularly, to automatic swimming pool cleaners movable along an underwater pool surface for purposes of cleaning debris therefrom. Still more particularly, this invention relates to swimming pool cleaners having the flow of water pumped and/or sucked by remote pumps into and through the pool cleaners.

BACKGROUND OF THE INVENTION

Automatic swimming pool cleaners of the type that move about the underwater surfaces of a swimming pool are driven by many different kinds of systems. A variety of different pool-cleaner devices in one way or another harness the flow of water, as it is drawn or pushed through the pool cleaner by the pumping action of a remote pump for debris collection purposes.

Suction automatic pool cleaners are very successful when there is fine debris or debris that become soft in water. This fine debris is sucked up by the cleaner and deposited into a pump basket, or other debris-collection device, and the really fine debris passes into the pool filter. An example of a suction cleaner is disclosed in commonly-owned U.S. Pat. No. 6,854,148 (Rief et al.), entire contents of which are incorporated herein by reference.

Suction automatic swimming pool cleaners are used in places with much sand and slit. Although suction cleaners can take leafy debris once it has softened in the pool, large debris such and large acorns and hard leafs would plug up a suction cleaner. Suction swimming pool cleaners are also limited to the debris size due to loss of suction if the inlet and/or outlet orifices are widened to accommodate such large debris and the possibility of large debris clogging the pool pipes.

Conversely, pressure automatic swimming pool cleaners are very successful when there is large debris such as leaves and acorns, these large debris are pulled off the pool surface by virtue of a venturi effect and are placed into a debris-collection device, such as a bag, above the cleaner. An example of a pressure cleaner is disclosed in commonly-owned U.S. Pat. No. 6,782,578 (Rief et al.), entire contents of which are incorporated herein by reference.

With a pressure swimming pool cleaner, the limitation is the opposite to the suction cleaner. In removing very large debris from the swimming pool, a pressure cleaner uses a collection bag. Regardless of how fine the bag is, sand and slit can pass through the bag back into the pool.

The problem is that most often only one cleaner is used in a pool. Therefore, people have either a suction cleaner or a pressure cleaner. Many swimming-pool builders place a suction cleaner into a pool when it is built. This is because there is no real landscaping around the pool at the time of the cleaner installation. However, just few years later, when trees and bushes have grown up, the debris becomes overwhelming and constantly plugs the suction cleaner.

Still with the pressure cleaner, no matter how large debris is in the pool, there is always sand and slit from cement and other elements of the surrounding environment. Such fine debris will pass through the debris-collection bag back into the pool. Although some swimming pool pressure cleaners have tails that supposedly whip the debris toward the main drain, in reality such tails only bring the dirt into suspension until it falls back on the pool bottom to start the process all over again.

Attempts have been made to utilize both a suction power and a pressure flow from remote pumps by the same swimming pool cleaner apparatus. One such apparatus is disclosed in U.S. Pat. No. 5,099,535 (Chauvier et al.). The apparatus of the Chauvier et al. patent is connected to both a pressure and suction remote pumps at the same time. However, only the suction hose is used for removal of the debris from the swimming pool underwater surface. The Chauvier et al. cleaner utilizes the pressure flow only for displacement of the cleaner along the underwater pool surface such that the Chauvier et al. cleaner remains a suction cleaner at all times and retains disadvantages of suction cleaners described earlier. Therefore, to remove large or hard debris from the swimming pool, one would have to use a separate cleaner or cleaning method which accommodates successful removal of such large debris. It should further be noted that, because suction and pressure line connectors are not in the same vicinity of a swimming pool, the connection to both lines at the same, as proposed by the Chauvier et al. patent, is practically not possible.

U.S. Pat. No. 7,168,120 (Habif et al.) discloses a pressure-fed vacuum swimming pool cleaning robot. The robot of the Habif et al. patent has a structure which extends from a debris-inlet end applied to the swimming-pool underwater surface to an opposite debris-outlet end which is distal from the underwater surface. In the robot of the Habif et al. patent, the suction is always created at the debris-outlet end by either a connection of the debris-outlet end to a suction hose or by creating a venturi effect at the debris-outlet. The structure of the Habif et al. patent consistently operates as a suction cleaner which successfully removes only fine or very soft debris. This structure is not configured for removal of large and hard debris which would plug up the debris inlet as well as inner passages of the Habif et al. robot. Therefore, as with the Chauvier et al. patent, large or hard debris would have to be removed from the swimming pool by a separate cleaner different from the robot of the Habif et al. patent or by some other means designed for removal of such large debris.

It would be beneficial to have a single cleaner which is successful is removing both fine and large debris from the swimming-pool underwater surface.

OBJECTS OF THE INVENTION

It is an object of the invention to provide an improved swimming pool cleaner overcoming some of the problems and shortcomings of the prior art, including those referred to above.

Another object of the invention is to provide an improved swimming pool cleaner which is able to successfully remove fine and large debris from the swimming-pool underwater surface.

Another object of the invention is to provide an improved single swimming pool cleaner which may operate as a suction cleaner or as a pressure cleaner.

Still another object of the present invention is to provide and improved swimming pool cleaner that is easily transformed from a pressure-cleaner type to a suction-cleaner type or from the suction-cleaner type to the pressure-cleaner type.

How these and other objects are accomplished will become apparent from the following descriptions and the drawings.

SUMMARY OF THE INVENTION

This invention is an improved swimming pool cleaner of the type movable along an underwater pool surface to clean debris therefrom. The swimming pool cleaner includes a body having a debris inlet and a debris outlet.

The swimming pool cleaner of the present invention provides an important advantage in that it can be interchangeably usable as a suction cleaner for removal of fine debris such as sand and slit and as a pressure cleaner for removal of large and hard debris such as large leaves, acorns and stones.

In the inventive swimming pool cleaner, the body is adapted at the debris outlet for securement of either a water-suction hose connected to a remote suction system or a debris-collection device entrapping debris and passing water therethrough back into the pool. When the cleaner is used as a pressure cleaner, a venturi-line structure is secured with respect to the body. The venturi-line structure includes a venturi-line inlet adapted for connection of a water-flow line fed by a remote pump and a venturi jet located at the debris inlet to cause accelerated flow substantially across the inlet and into the body. The body further includes a debris-inlet adjuster configured to reduce the debris inlet to adapt the cleaner for use as a suction cleaner.

In preferred embodiments of the present invention, the debris-inlet adjuster is removably secured to the body at the debris inlet to maintain suction power when the swimming pool cleaner is used as a suction cleaner.

The venturi-line structure may be permanently affixed to the body such that the venturi jet is selectively closeable by a venturi-jet cover. The venturi-line structure is preferably integrally molded with the body. In such embodiments, the debris-inlet adjuster is preferably a single piece including the venturi-jet cover, thereby to reduce the debris inlet and at the same time to close the venturi jet to facilitate adaption of the cleaner for use as a suction cleaner.

In some other embodiments, the venturi-line structure may be removably secured with respect to the body such that the venturi-line structure is disconnected from the body when the cleaner is used as the suction cleaner.

It is preferred that the body is adapted at the debris outlet for securement of a removable debris-outlet adjuster configured to reduce the debris outlet for connection to the water-suction hose. The debris-outlet adjuster preferably extends inwardly from an outer portion to an inner portion of the debris-outlet adjuster. The outer portion is preferably configured for attachment to cleaner-body walls which define the debris outlet. The inner portion preferably defines the reduced debris outlet and includes the connection to the water-suction hose.

In preferred embodiments, the connection to the water-suction hose is a swivel connection. The swivel connection may be of the type disclosed in commonly-owned U.S. Pat. No. 6,733,046 (Rief), entire contents of which are incorporated herein by reference. However, any other known connection may also be used.

The body preferably defines a water-flow chamber through which water passes from the debris inlet to the debris outlet. In preferred embodiments, the inventive swimming pool cleaner is of the type motivated by water flow through it to move the cleaner along the underwater pool surface to be cleaned. In such preferred embodiments, a turbine may be rotatably mounted within the water-flow chamber. The turbine preferably has turbine vanes which are moved by the water flow to rotate the turbine.

It is further preferred that a set of wheels be rotatably mounted with respect to the body for engagement with the underwater pool surface. The set of wheels preferably includes two wheels on each side of the body. The wheels are preferably driven by a rotational linkage with the turbine to propel the pool cleaner along the underwater surface. The rotatable linkage may be in the form of a set of gears or other known linkage such as a flexible belt or the like.

It is preferred that the turbine includes a turbine rotor rotatably mounted in the chamber. A drive member is secured to the rotor and a drive train from the drive member drives the wheels on underwater pool surfaces. The improved cleaner of this invention provides excellent power and drive particularly when the turbine is in the highly preferred forms which are the subject of U.S. Pat. No. 6,292,970, entitled "Turbine-Driven Automatic Swimming Pool Cleaners," to Dieter J. Rief and Manuela Rief, the inventors herein, and Rosemarie Rief.

Preferred embodiments of the inventive swimming pool cleaner include a steering mechanism which is sometimes referred to as "internal." The steering mechanism preferably includes a cam having portions of greater and lesser radii which rotatably secured to the body and driven by the rotor through reduction gearing, and a linkage from the cam to a wheel to periodically interrupt synchronous rotation of the wheels on the pool surface. Such internal steering mechanism is described in detail in above-mentioned '578 Rief et al. patent.

In some preferred embodiments, a brush is rotatably secured with respect to the body adjacent the debris inlet such that the brush engages the underwater pool surface to facilitate debris removal from the underwater pool surface into the debris inlet. It is preferred that the brush be driven by the rotational linkage with the turbine. The brush may be driven by the turbine rotation either directly or indirectly. In some embodiments, the brush is driven directly by the rotation of the wheels.

The debris-inlet adjuster is preferably configured to focus the flow of water from the reduced debris inlet toward the turbine vanes, thereby to facilitate rotation of the turbine when the cleaner operates as a suction cleaner.

When the cleaner operates as a pressure cleaner, the venturi jet is preferably positioned to direct water toward the turbine vanes to facilitate rotation of the turbine.

The inventive swimming pool cleaner may further include a propulsion nozzle secured to the venturi-line structure and having a propulsion inlet which receives water from the venturi line and a propulsion outlet which ejects such water away from the pool-cleaner body when the cleaner is used as a pressure cleaner. Such propulsion nozzle may serve as a pressure release in the venturi line.

Alternatively, the propulsion nozzle may be configured to propel the pool cleaner in the direction opposite the direction of the water ejected from the propulsion outlet. In such embodiments, the propulsion nozzle has a cross-section which decreases from the propulsion inlet to the propulsion outlet to accelerate the water flow therethrough.

It should be understood that the inventive swimming pool cleaner may utilize different types of propulsion. It can utilize a propeller propulsion or the turbine-drive, an example of which is described above. Alternatively, the cleaner may be motivated by an oscillator or hammer propulsion, a motor propulsion, use a venturi propulsion, an electrical motor or other types of propulsion known in the art.

Another aspect of the present invention is a method of converting a swimming-pool pressure cleaner to a swimming-pool suction cleaner. The pressure cleaner is of the type including a body having a debris inlet and a debris outlet, the debris outlet configured for securement of a debris-collection device entrapping debris and passing water therethrough back into the pool, and a venturi-line structure affixed to the body. The venturi-line structure includes a venturi-line inlet adapted for connection of a water-flow line fed by a remote pump and a venturi jet located at the debris inlet.

The inventive method includes the steps of reducing the debris inlet with a debris-inlet adjuster positioned at the debris inlet, isolating the venturi jet, adjusting the debris outlet for connection to the water-suction hose, and connecting the debris outlet to the water-suction hose.

The inventive method may further include the prior steps of removing the debris-collection device from the debris outlet and disconnecting the water-flow line from the venturi-line inlet.

In the embodiments with the venturi-line structure permanently affixed to the body, the venturi jet is preferably selectively closeable by a venturi-jet cover. The debris-inlet adjuster is preferably a single piece including the venturi-jet cover. In such embodiments, the debris-inlet adjuster reduces the debris inlet and at the same time closes the venturi jet to facilitate adaption of the cleaner for use as a suction cleaner.

Still another aspect of the present invention is a method of converting a swimming-pool suction cleaner to a swimming-pool pressure cleaner. The suction cleaner is of the type including a body having a debris inlet and a debris outlet, the debris outlet configured for securement of a water-suction hose connected to a remote suction system.

Such inventive method includes the step of increasing the debris inlet to accommodate intake of large debris. The increasing step may be by a removal of a portion of an inlet-defining wall of the body. Such removal may further be coupled with an installation of a debris-inlet adjustor further modifying the debris inlet for the efficient cleaner operation.

The debris outlet is preferably adapted for connection of a debris-collection device entrapping debris and passing water therethrough back into the pool. The debris outlet is preferably increased to accommodate intake of large debris. Such increasing may be achieved by either removing the reducing debris-outlet adjustor or by other applicable methods depending on a construction of the body.

The inventive method may further include the prior step of disconnecting the water-suction hose from the debris outlet.

This inventive method also includes the step of adapting a venturi-line structure for operation. Such adapting step may include connecting the venturi-line inlet to a water-flow line fed by a remote pump and opening the venturi jet located at the debris inlet to cause accelerated flow substantially across the inlet and into the body.

The venturi-line structure may be separate from the body. In such embodiments, the step of adapting the venturi-line structure includes securing the venturi-line structure with respect to the body.

Alternatively, the venturi-line structure may be permanently affixed to the body, with the venturi jet being preferably selectively closeable by a venturi-jet cover. The reducing debris-inlet adjuster is preferably a single piece including the venturi-jet cover. In such embodiments, converting of the suction cleaner to the pressure cleaner includes a step of removing the reducing debris-inlet adjuster to increase the debris inlet and at the same time open the venturi jet.

The term "debris-collection device," as used herein, refers to a debris-entrapping arrangement such as disposable or reusable flexible bags or a rigid container designed to retain debris received from the debris inlet. The debris-collection device may either directly communicate with the debris inlet or receive debris through an intermediate passageway connected to the debris inlet.

DETAILED DESCRIPTION OF PREFERRED EMBODIMENTS

Figure 1:
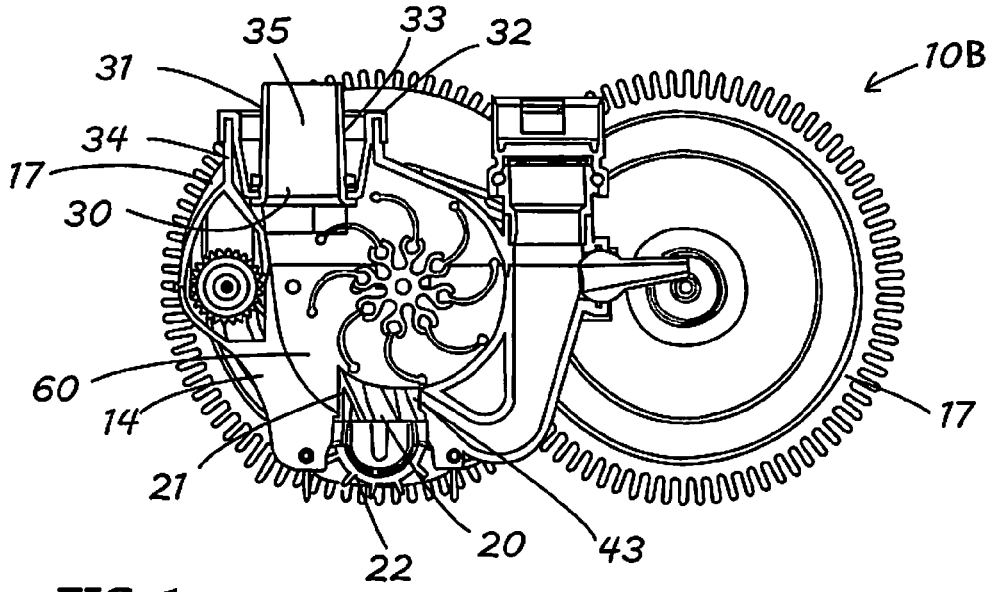
FIG. 1 is a cross-sectional side view of an inventive swimming pool cleaner converted from a pressure cleaner to a suction cleaner.

FIGS. 1-10 illustrate a preferred swimming pool cleaner 10 in accordance with the present invention. Swimming pool cleaner 10 is of the type movable along an underwater pool surface 11 to clean debris 12 therefrom. Swimming pool cleaner 10 includes a body 14 having a debris inlet 20 and a debris outlet 30. FIGS. 1-4 show preferred body 14 formed of two or more plastic pieces designed to accommodate the parts and features of the invention.

Figure 2:
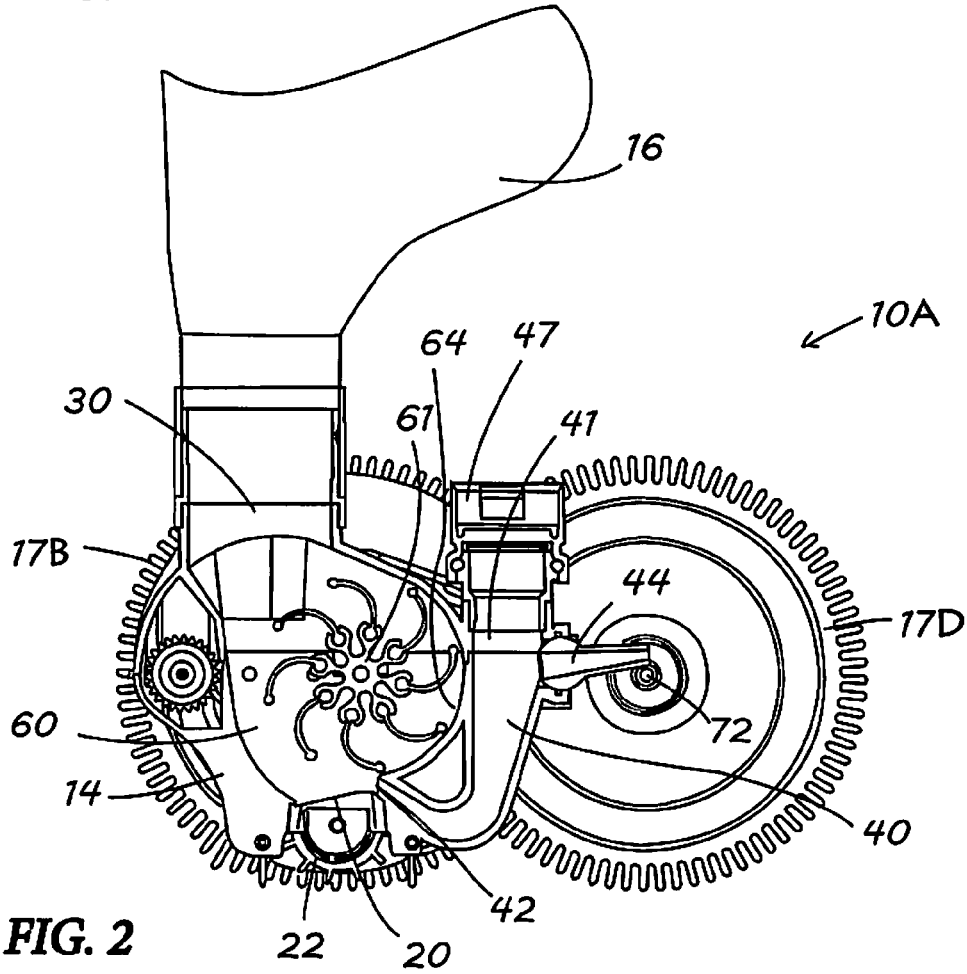
FIG. 2 is a cross-sectional side view of an inventive swimming pool cleaner operating as a pressure cleaner.
Figure 3:
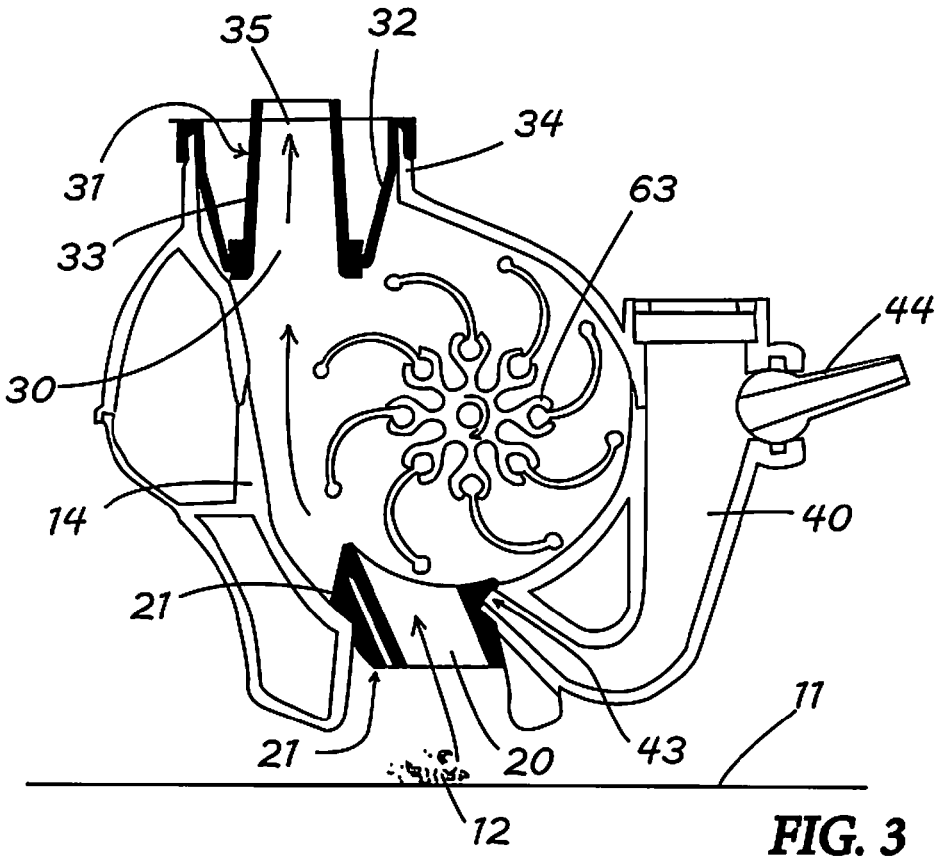
FIG. 3 is a cross-sectional fragmental side view of an inventive swimming pool cleaner of FIG. 1.
Figure 4:
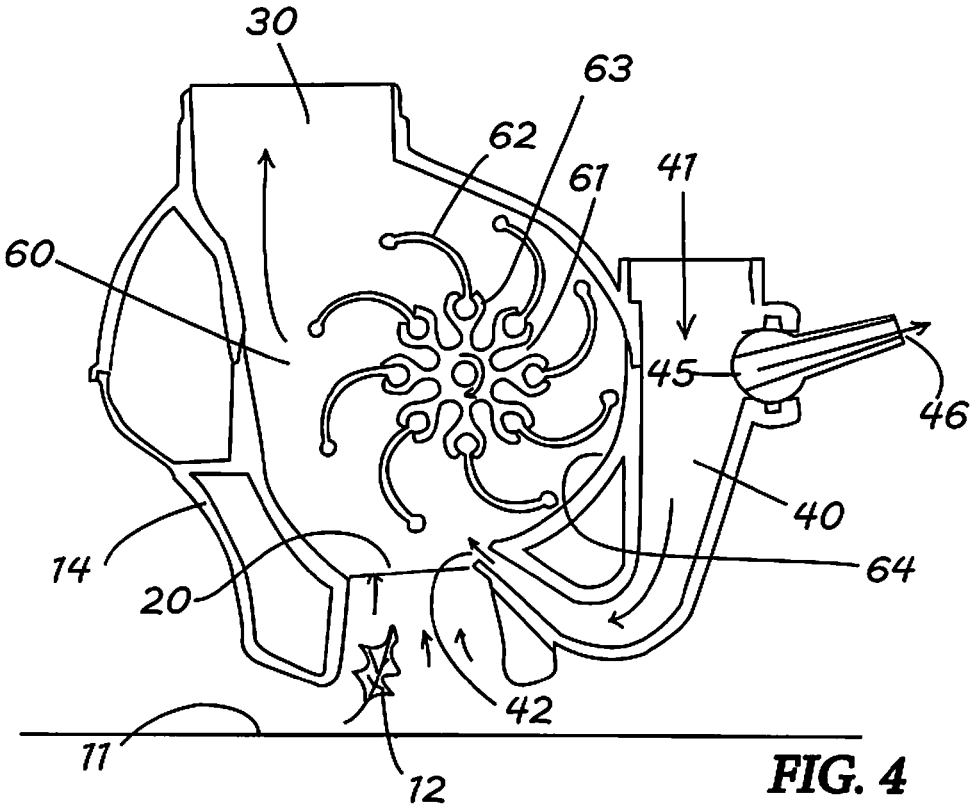
FIG. 4 is a cross-sectional fragmental side view of an inventive swimming pool cleaner of FIG. 2.

As best seen in FIGS. 1-4, body 14 is adapted at debris outlet 30 for securement of either a water-suction hose 15 connected to a remote suction system or a debris-collection device 16 entrapping debris and passing water therethrough back into the pool. FIGS. 2, 4-6 show cleaner 10 used as a pressure cleaner 10A with a venturi-line structure 40 secured with respect to body 14. As best seen in FIGS. 2 and 4, venturi-line structure 40 includes a venturi-line inlet 41 adapted for connection of a water-flow line fed by a remote pump and a venturi jet 42 located at debris inlet 20 to cause accelerated flow substantially across inlet 20 and into body 14.

Body 14 further includes a debris-inlet adjuster 21 (seen in FIGS. 1 and 3) configured to reduce debris inlet 20 to adapt the cleaner for use as a suction cleaner 10B. FIGS. 1 and 3 show debris-inlet adjuster 21 removably secured to body 14 at debris inlet 20 to maintain suction power when swimming pool cleaner 10 is used as suction cleaner 10B.

FIGS. 1-4 show venturi-line structure 40 permanently affixed to body 14 such that venturi jet 42 is selectively closeable by a venturi-jet cover 43. It is further seen in FIGS. 3 and 4 that venturi-line structure 40 is integrally molded with body 14. FIGS. 1 and 3 also show that debris-inlet adjuster 21 is a single piece which includes venturi-jet cover 43. Such single-piece debris-inlet adjuster 21 reduces debris inlet 20 and at the same time closes venturi jet 42 to facilitate adaption of cleaner 10 for use as suction cleaner 10B.

As further seen in FIGS. 1 and 3, body 14 is adapted at debris outlet 30 for securement of a removable debris-outlet adjuster 31 configured to reduce debris outlet 30 for connection to water-suction hose 15. Debris-outlet adjuster 31 shown in FIGS. 1 and 3 extends inwardly from an outer portion 32 to an inner portion 33 of debris-outlet adjuster 31. Outer portion 32 preferably configured for attachment to cleaner-body walls 34 which define debris outlet 30. Inner portion 33 defines reduced debris outlet 30 and includes a connection 35 to water-suction hose 15.

Figure 11:
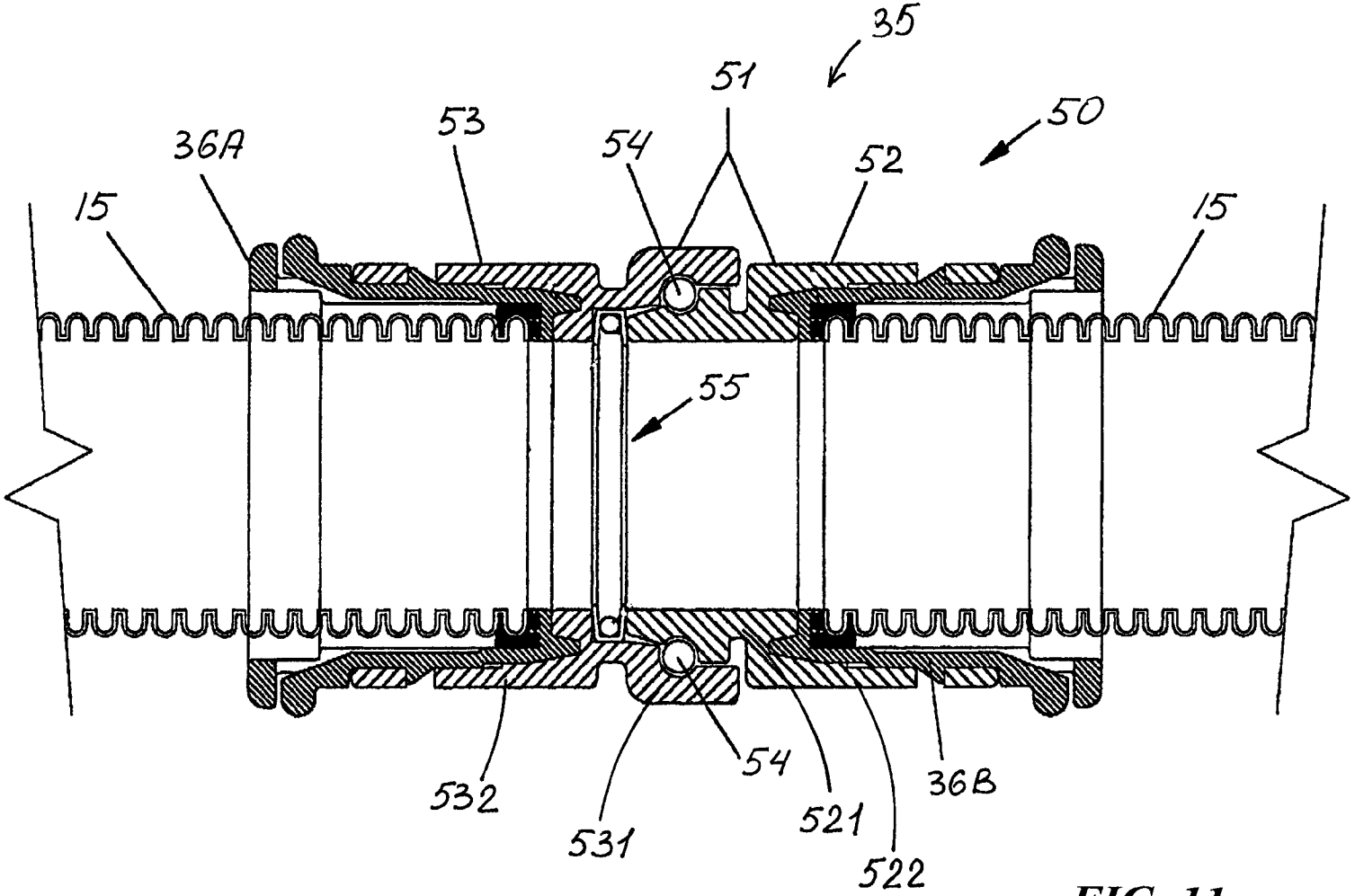
FIG. 11 is a cross-sectional view of a hose swivel connection.

FIG. 11 shows connection 35 to water-suction hose 15 as a swivel connection 50 which includes a swivel device 51 to which hose-end couplings 36A and 36B are removably attached. It is seen in FIG. 11 that swivel device 51 includes a male swivel member 52 and a female swivel member 53 which are held together in free swiveling relationship by a multiplicity of hard spherical bearing balls 54. Swivel device 51 also includes a ring seal 55 positioned between male swivel member 52 and female swivel member 53.

As further shown in FIG. 11, male swivel member 52 includes an underlap portion 521 and a coupling engagement portion 522. Male swivel member 52 is shown as a unitary plastic piece molded of a suitable hard plastic material of a type well known in field of pool cleaners and the like. Suitable plastics or other materials are apparent to those skilled in the art who are made aware of this invention.

As also shown in FIG. 11, female swivel member 53, like male swivel member 52, is an integral piece molded of a suitable plastic material. Female swivel member 53 includes an overlap portion 531 which is concentric with and overlaps underlap portion 521 of male swivel member 52. Female swivel member 53 also includes a coupling engagement portion 532.

FIGS. 1-4 and 6 show that body 14 defines a water-flow chamber 60 through which water passes from debris inlet 20 to debris outlet 30. Swimming pool cleaner 10 is of the type motivated by water flow through it to move cleaner 10 along the underwater pool surface 11 to be cleaned. It is best seen in FIGS. 1-4 and 6 that a turbine 61 is rotatably mounted within water-flow chamber 60. Turbine 61 includes a rotor 63, which is rotatably mounted within chamber 60, and a number of turbine vanes 62. Each vane 62 is generally cylindrical in shape and is loosely received within a generally cylindrical void in rotor 63, formed just below the outer surface of the rotor. Thus, vanes 62, which are of a curved configuration, freely move between fully extended positions in which they contact chamber wall 64 and retracted positions in which their distal edges are closer to rotor 63 and spaced from chamber wall 64. This provides free adjustability of vanes 62 to facilitate passage of large pieces of debris 12 to pass through chamber 60 without interfering with operation of the turbine. Chamber 60 is of substantial size to further facilitate flow of debris. Turbine vanes 62 are moved by the water flow to rotate turbine 61.

As seen in FIGS. 1 and 3, debris-inlet adjuster 21 is configured to focus the flow of water from the reduced debris inlet 20 toward turbine vanes 62, thereby to facilitate rotation of turbine 61 when cleaner 10 operates as suction cleaner 10B.

It is seen in FIGS. 2 and 4 that, when cleaner 10 operates as a pressure cleaner 10A, venturi jet 42 is positioned to direct water flow toward turbine vanes 62 to facilitate rotation of turbine 61.

FIGS. 1, 2, 5 and 6 show a set of wheels 17 rotatably mounted with respect to body 14 for engagement with the underwater pool surface 11. The set of wheels includes two wheels 17 on each side of body 14. Wheels 17 are driven by rotational linkage 70 with turbine 61 to propel pool cleaner 10 along the underwater surface 11.

Figure 5:
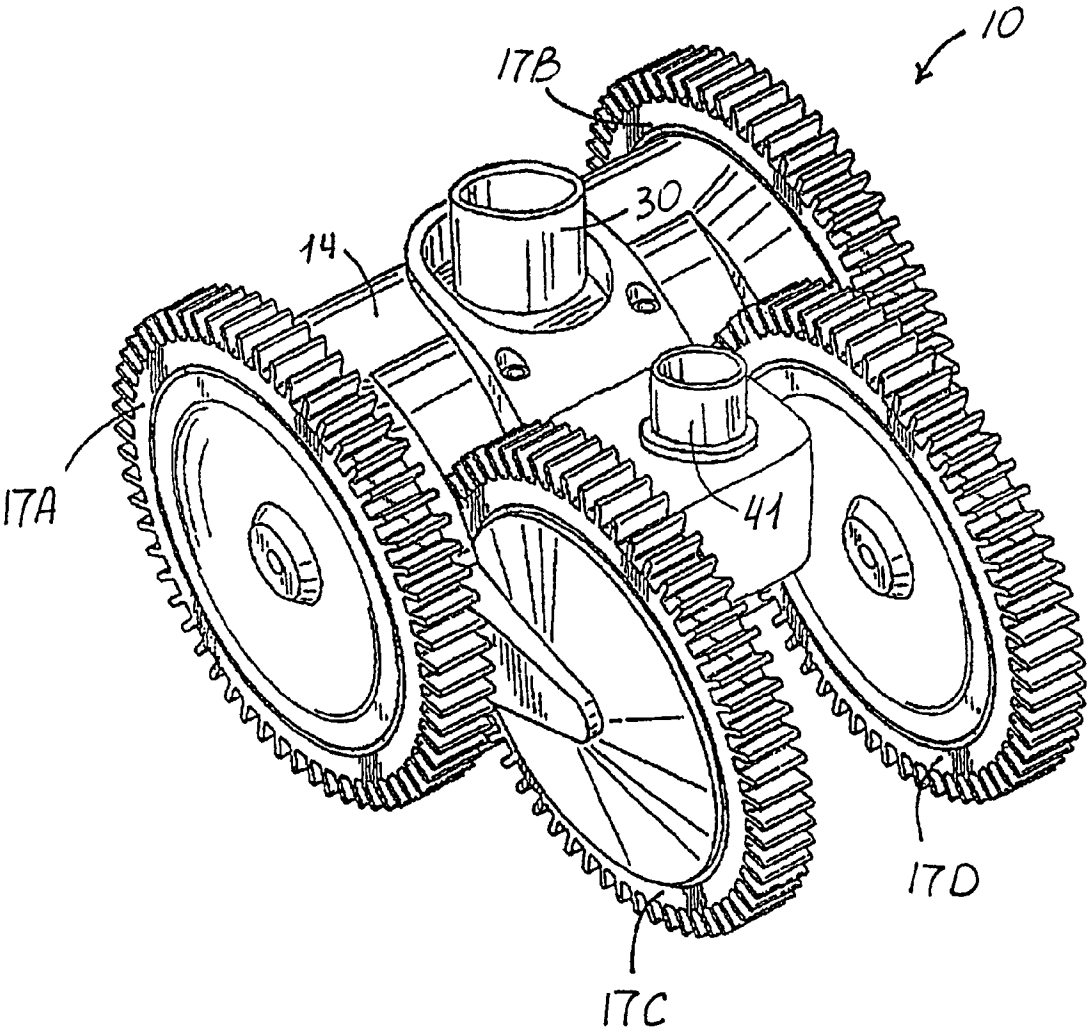
FIG. 5 is a perspective view of the inventive swimming pool cleaner of FIG. 2.
Figure 6:
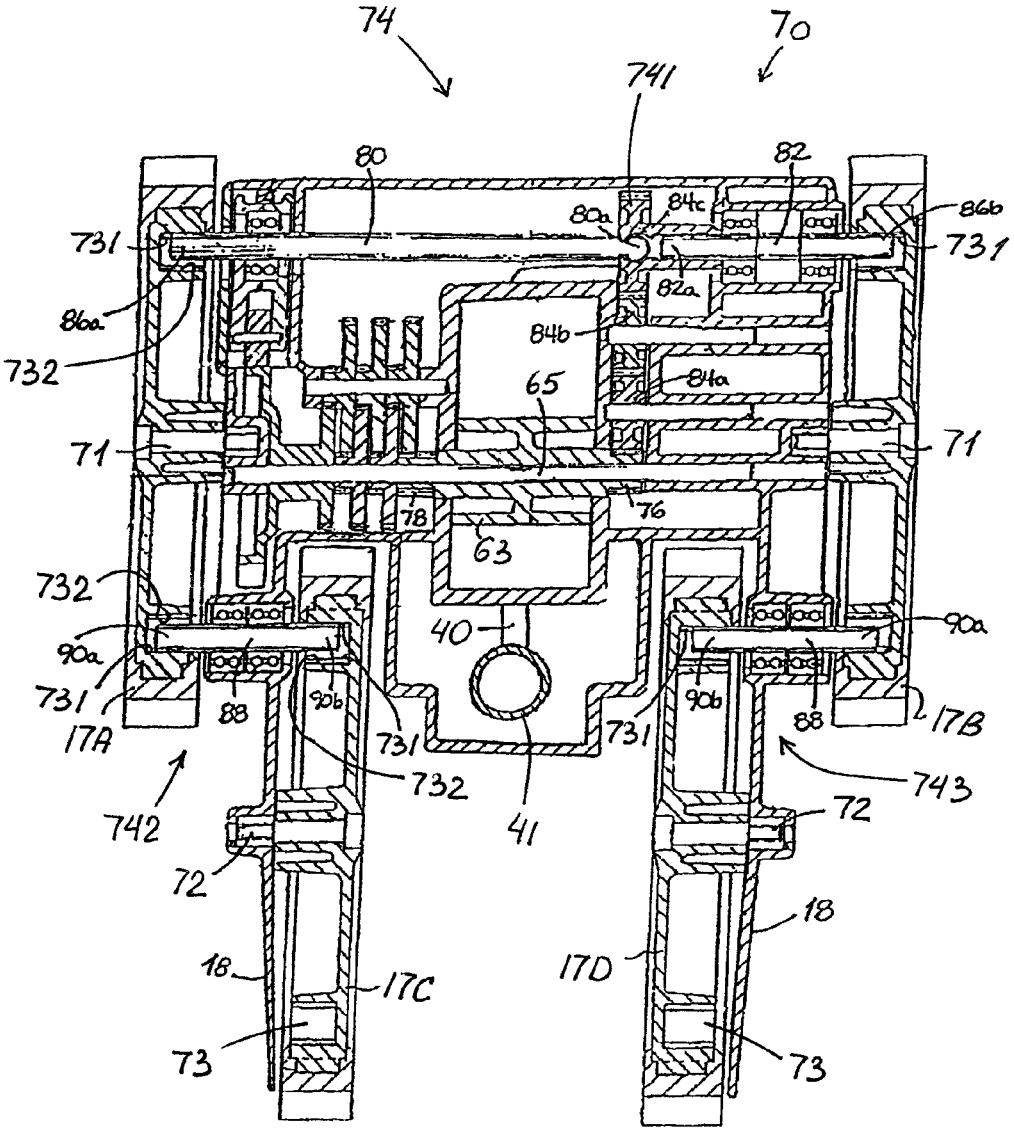
FIG. 6 is a cross-sectional top view showing a rotational linkage of the inventive swimming pool cleaner of FIG. 2.
Figure 7:
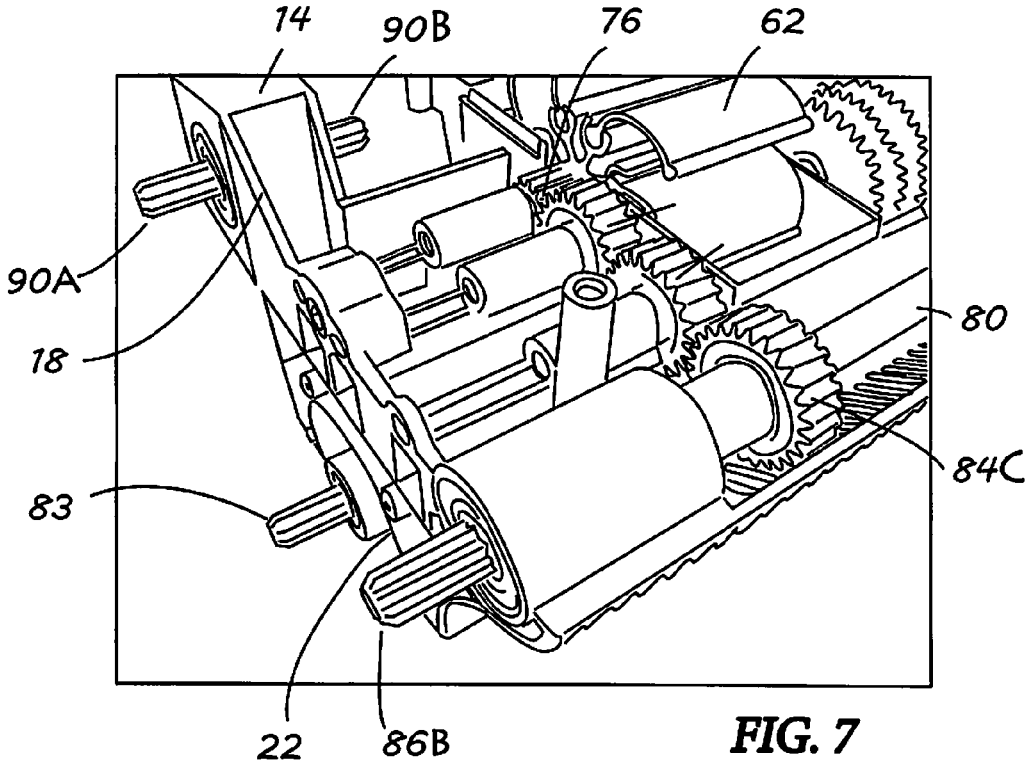
FIG. 7 is a fragmental perspective view from above of a rotational linkage with the turbine, including an internal drive-train gear set.
Figure 8:
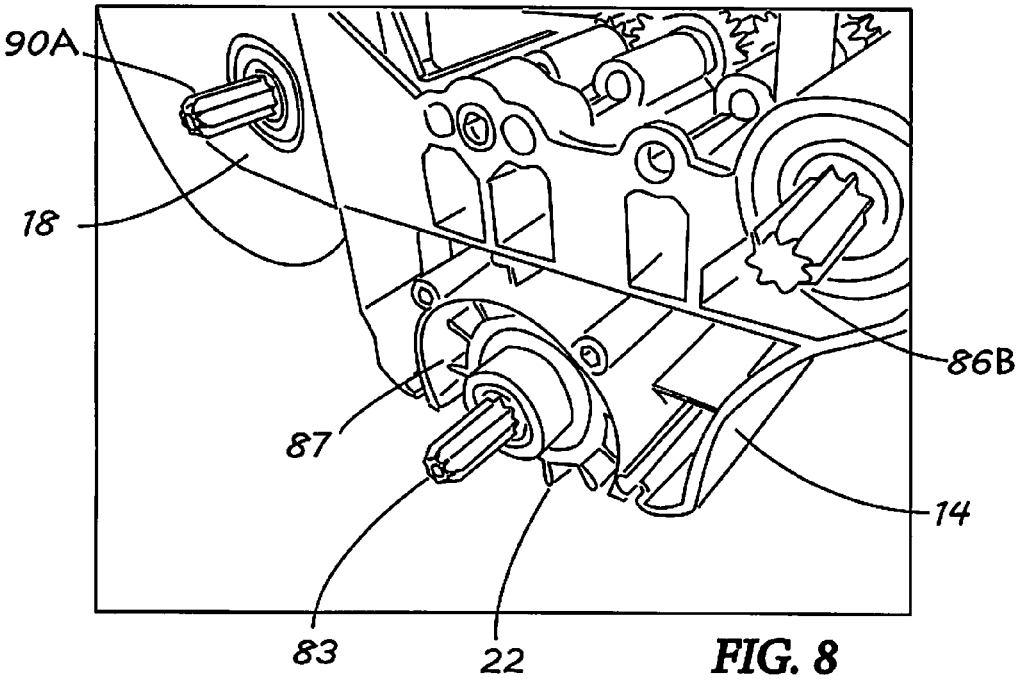
FIG. 8 is a fragmental perspective side view showing a brush in place and wheels removed.

As best seen in FIGS. 5 and 6, pool cleaner 10 has four identical drive wheels 17, including left front drive wheel 17A, right front drive wheel 17B, and left and right rear drive wheels 17C and 17D. All four drive wheels 17 are driven to provide forward movement of pool cleaner 10. Rear drive wheels 17C and 17D are driven by separate linkages from front wheels 17A and 17B, respectively.

Left front drive wheel 17A, which is normally driven in a forward direction, is periodically temporarily driven in a reverse direction. When this occurs, left rear drive wheel 17C is also driven in a reverse direction by virtue of the linkage between drive wheels 17A and 17C. During such brief intermittent periods of reverse rotation, the direction of travel of pool cleaner 10 changes. This steering function, together with the power provided by four-wheel drive of this invention, provides excellent cleaning coverage of underwater pool surfaces 11.

FIGS. 6-9 illustrate rotational linkage 70. Front drive wheels 17A and 17B are rotatably mounted to body 14 on wheel shafts 71, as shown in FIG. 6. Attached to body 14 are rear wheel supports 18, and rear wheels 17C and 17D are rotatably mounted thereon by rear-wheel shafts 72. Front wheels 17A and 17B have gearing 73 on their inward surfaces, i.e., the surfaces facing each other. Rear wheels 17C and 17D have the same gearing 73 on their outward surfaces. Drive wheels 17A-D are identical to each other, and thus are interchangeable.

Gearing 73 on wheels 17A-D includes concentric radially-spaced primary and secondary wheelgears 731 and 732. Primary and secondary wheelgears 731 and 732 are radially spaced from one another by a distance in excess of the diameter of a pinion gear (hereafter described) which alternately engages such gears 731 and 732 on drive wheel 17A. While all wheels 17 are interchangeable, only drive wheel 17A uses both wheelgears 731 and 732; on drive wheels 17B-D, only wheelgear 731 is used.

Turbine 61 uses flow of water to create rotary motion for transfer to wheels 17 by a drive train 74. FIG. 6 is particularly helpful in illustrating drive train 74 and its three different portions which include: (1) a first portion 741 which extends from a first drive gear 76, affixed to rotor 63, to left and right front wheels 17A and 17B; (2) a second portion 742 which extends from front wheel 17A to rear wheel 17C; and (3) a third portion 743 which is identical to second portion 742 and extends from front wheel 17B to rear wheel 17D. All four wheels 17 are driven by first drive gear 76 and a second drive gear 78. Second drive gear 78 is affixed to the opposite side of rotor 63 and is used to control the steering of pool cleaner 10. (First and second drive gears 76 and 78 are integrally formed with rotor 63 and are affixed to a rotor shaft 65 which is rotatably mounted with respect to body 14.)

First drive train portion 741 includes left and right drive shafts 80 and 82, sometimes referred to as "first" and "second" drive shafts. They are in end-to-end alignment. First drive train portion 741 also includes a gear train having gears 84*a*, 84*b* and 84*c*. Gear 84*c* also serves as a coupler receiving the proximal ends 80*a* and 82*a* of drive shafts 80 and 82. (Proximal end 80*a* of drive shaft 80 forms a ball-joint coupling with coupling gear 84*c*, for steering-related purpose.) Drive shafts 80 and 82 terminate at their distal ends in pinion gears 86*a* and 86*b*, which are integrally formed with shafts 80 and 82. Pinion gears 86*a* and 86*b* engage primary wheelgears 731 of drive-train wheels 17A and 17B, respectively. Thus, the rotation of rotor 63 causes synchronous rotation of front drive wheels 17A and 17B, each in the same direction.

The rotation of front drive wheels 17A and 17B causes rotation of rear drive wheels 17C and 17D, by means of the second and third drive-train portions 742 and 743. Each of these identical drive-train portions 742 and 743 ends up engaging primary (or final) wheelgear 731 of one of rear drive wheels 17C and 17D. Adjacent to each rear wheel 17C and 17D is a transfer shaft 88 journaled in body 14 by means of appropriate bearings. The opposite ends of each transfer shaft 88 include pinion gears 90*a* and 90*b*, which are formed as part of transfer shaft 88. Each pinion gear 90*a* engages primary wheelgear 731 of one of front drive wheels 17A or 17B, at a position spaced about 180 degrees from the point of engagement of pinion gear 86*a* or 86*b* therewith. Each pinion gear 90*b* engages primary (or final) wheelgear 731 of one of rear drive wheels 17C and 17D.

Figure 9:
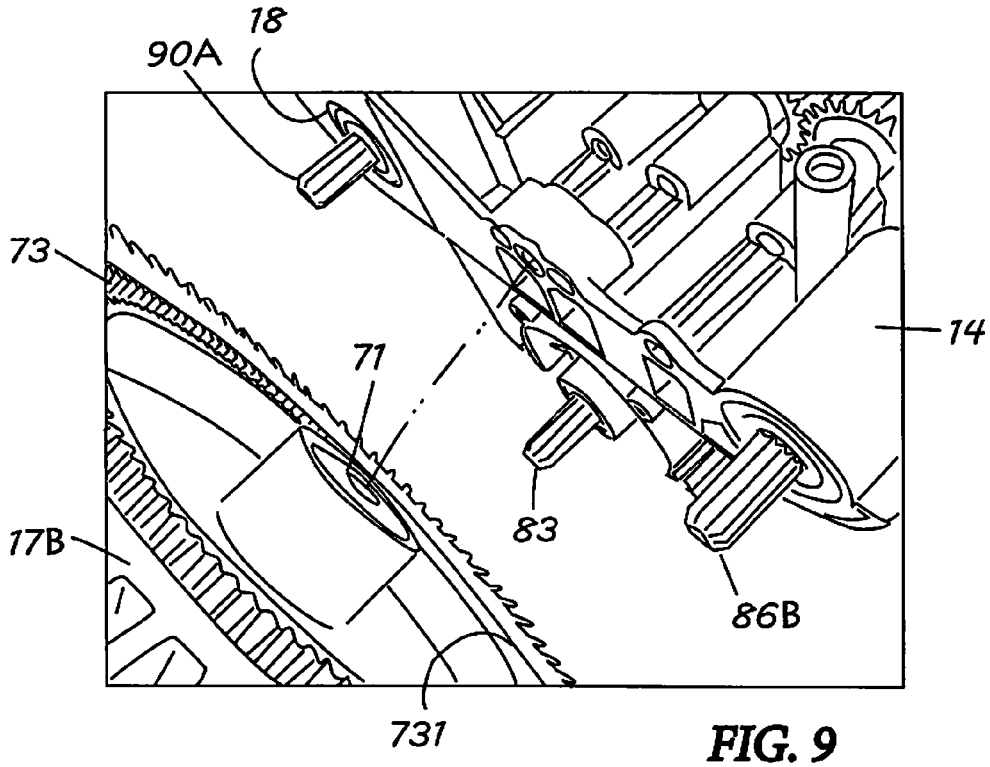
FIG. 9 is a fragmental perspective view showing the brush pinion gear and a wheel removed but adjacent to the cleaner.
Figure 10:
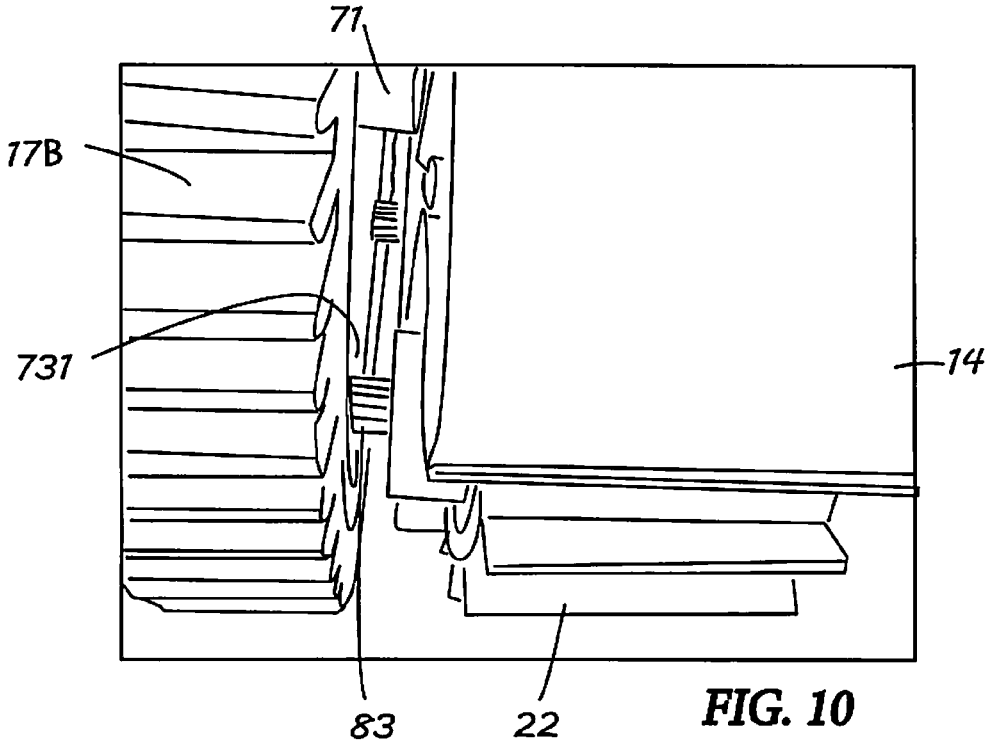
FIG. 10 is a fragmental perspective view from above showing a direct-drive brush engagement with the wheel.

FIGS. 1, 2 and 7-10 show a brush 22 rotatably secured with respect to the body adjacent debris inlet 20 such that brush 22 engages underwater pool surface 11 to facilitate debris removal from underwater pool surface 11 into debris inlet 20. FIGS. 7-10 show brush 22 driven by rotational linkage 70 with turbine 61. As best seen in FIGS. 9 and 10, brush 22 is driven directly by front wheel 17B. More specifically, brush 22 is mounted on a brush shaft 81 which includes a brush-pinion gear 83. Brush shaft 81 is mounted to body 14 such that brush-pinion gear 83 is positioned to engage primary (or final) wheelgear 731. Therefore, the front-wheel rotation results in the rotation of brush 22. Swimming pool cleaner 10 includes two brushes 22, each of which is positioned on one side of debris inlet 20 and is driven by the adjacent front wheel 17A or 17B.

FIGS. 1-4 further show that inventive swimming pool cleaner 10 further includes a propulsion nozzle 44 secured to venturi-line structure 40 and having a propulsion inlet 45 which receives water from the venturi line and a propulsion outlet 46 which ejects such water away from pool-cleaner body 14 when cleaner 10 is used as pressure cleaner 10A. FIGS. 1 and 2 best show propulsion nozzle 44 having a cross section which decreases from propulsion inlet 45 to propulsion outlet 46 to accelerate the water flow therethrough.

FIGS. 1-4 further illustrate a method of converting swimming-pool pressure cleaner 10A to swimming-pool suction cleaner 10B. FIGS. 2 and 4 show pressure cleaner 10A of the type including body 14 having debris inlet 20, debris outlet 30 and venturi-line structure 40 affixed to body 14. It is seen that debris outlet 30 is configured for securement of debris-collection device 16 in a form of a bag entrapping debris and passing water therethrough back into the pool. Venturi-line structure 40 includes venturi-line inlet 41 adapted for connection of a water-flow line fed by a remote pump and venturi jet 42 located at debris inlet 20.

The inventive method includes the steps of reducing debris inlet 20 with debris-inlet adjuster 21 inserted into debris inlet 20, isolating venturi jet 42, adjusting debris outlet 30 for connection to water-suction hose 15, as shown in FIGS. 1 and 3, and connecting debris outlet 30 to water-suction hose 15.

The inventive method further includes the prior steps of removing the debris-collection device 16 from the debris outlet, seen in FIG. 2, and disconnecting a water-flow line from venturi-line inlet 41. FIG. 2 further shows venturi-line structure 40 having a venturi-inlet adaptor 47 which is a swivel connector similar to swivel connector 50.

In FIGS. 1-4, venturi-line structure 40 is permanently affixed to body 14 such that venturi jet 42 is selectively closeable by venturi-jet cover 43. Debris-inlet adjuster 21 is shown as a single piece including venturi-jet cover 43 to reduce debris inlet 20 and at the same time close venturi jet 42 to facilitate adaption of pressure cleaner 10A for use as suction cleaner 10B.

While the principles of the invention have been shown and described in connection with specific embodiments, it is to be understood that such embodiments are by way of example and are not limiting.

The invention claimed is:

1. In a swimming pool cleaner movable along an underwater pool surface to clean debris therefrom, the pool cleaner including a body having a debris inlet and a debris outlet, the improvement comprising:

the body being adapted at the debris outlet for securement of either a water-suction hose connected to a remote suction system or a debris-collection device entrapping debris and passing water therethrough back into the pool;

a venturi-line structure secured with respect to the body, the venturi-line structure including a venturi-line inlet adapted for connection of a water-flow line fed by a remote pump and a venturi jet located at the debris inlet to cause accelerated flow substantially thereacross and into the body when the cleaner is used as a pressure cleaner; and the body including a debris-inlet adjuster configured to reduce the debris inlet to adapt the cleaner for use as a suction cleaner, whereby the pool cleaner is interchangeably usable as a suction cleaner and as a pressure cleaner;

wherein the venture jet is selectively closeable by a venture-jet cover;

wherein the debris-inlet adjuster including the venture-jet cover, thereby to reduce the debris-inlet and at the same tone close the venture jet to facilitate adaption of the cleaner for use as a suction cleaner.

2. The pool cleaner of claim 1 wherein the debris-inlet adjuster is removably secured to the body at the debris inlet to maintain suction power when the swimming pool cleaner is used as a suction cleaner.

3. The pool cleaner of claim 1 wherein:

the venturi-line structure is permanently affixed to the body.

4. The pool cleaner of claim 3 wherein the venturi-line structure is integrally molded with the body.

5. The pool cleaner of claim 3 wherein the debris-inlet adjuster is a single piece.

6. The pool cleaner of claim 1 wherein the body is adapted at the debris outlet for securement of a removable debris-outlet adjuster configured to reduce the debris outlet for connection to the water-suction hose.

7. The pool cleaner of claim 6 wherein the debris-outlet adjuster extends inwardly from an outer portion configured for attachment to cleaner-body walls defining the debris outlet to an inner portion defining the reduced debris outlet and including the connection to the water-suction hose.

8. The pool cleaner of claim 7 wherein the connection to the water-suction hose is a swivel connection.

9. The pool cleaner of claim 1 wherein:

the body defining a water-flow chamber passing water therethrough from the debris inlet to the debris outlet;

a turbine rotatably mounted within the water-flow chamber, the turbine having turbine vanes moved by the water flow to rotate the turbine; and a brush rotatably secured with respect to the body adjacent the debris inlet and driven by rotational linkage with the turbine for engagement with the underwater pool surface to facilitate debris removal from the underwater pool surface into the debris inlet.

10. The pool cleaner of claim 1 further comprising:

the body defining a water-flow chamber passing water therethrough from the debris inlet to the debris outlet;

a turbine rotatably mounted within the water-flow chamber, the turbine having turbine vanes moved by the water flow to rotate the turbine; and a set of wheels rotatably mounted with respect to the body for engagement with the underwater pool surface and driven by rotational linkage with the turbine to propel the pool cleaner along the underwater surface.

11. The pool cleaner of claim 10 wherein the set of wheels includes two wheels on each side of the body.

12. The pool cleaner of claim 10 further including a brush rotatably secured with respect to the body adjacent the debris inlet and driven by rotational linkage with the wheels for engagement with the underwater pool surface to facilitate debris removal from the underwater pool surface into the debris inlet.

13. The pool cleaner of claim 10 wherein the debris-inlet adjuster is configured to focus the flow of water from the reduced debris inlet toward the turbine vanes, thereby to facilitate rotation of the turbine.

14. The pool cleaner of claim 10 wherein the venturi jet is positioned to direct water toward the turbine vanes to facilitate rotation of the turbine.

15. A method of converting a swimming-pool pressure cleaner to a swimming-pool suction cleaner, the pressure cleaner including (a) a body having a debris inlet and a debris outlet, the debris outlet configured for securement of a debris-collection device entrapping debris and passing water therethrough back into the pool and (b) a venturi-line structure affixed to the body, the venturi-line structure including a venturi-line inlet adapted for connection of a water-flow line fed by a remote pump and a venturi jet located at the debris inlet, the method comprising:

reducing the debris inlet with a debris-inlet adjuster positioned at the debris inlet;

isolating the venturi jet;

adjusting the debris outlet for connection to the water-suction hose; and connecting the debris outlet to the water-suction hose;

selectively closing the venture-jet a venturi-jet cover, the debris-inlet adjuster including the venture-jet cover, thereby to reduce the debris inlet and at the same time close the venture jet to facilitate adaptation of the cleaner for use as a suction cleaner.

16. The method of claim 15 further including the prior steps of removing the debris-collection device from the debris outlet and disconnecting the a water-flow line from the venturi-line inlet.

17. The method of claim 15 wherein the debris-inlet adjuster is removably secured to the body at the debris inlet, the debris-inlet adjuster configured to reduce the debris inlet.

18. The pool cleaner of claim 17 wherein:

the venturi-line structure is permanently affixed to the body.

19. The pool cleaner of claim 18 wherein the debris-inlet adjuster is a single piece.

20. The method of claim 15 wherein the adjusting step is by securing a removable debris-outlet adjuster to the body at the debris outlet, the debris-outlet adjuster configured to reduce the debris outlet for connection to the water-suction hose.

* * * * *

UNITED STATES PATENT AND TRADEMARK OFFICE

CERTIFICATE OF CORRECTION

PATENT NO. : 8,402,585 B2
APPLICATION NO. : 12/581405
DATED : March 26, 2013
INVENTOR(S) : Rief et al.

It is certified that error appears in the above-identified patent and that said Letters Patent is hereby corrected as shown below:

In the Claims

In column 10, claim 1, line 21, replace the word "tone" with the word --time--.

In column 12, claim 15, line 5, insert the word --by-- after the words "venture-jet."

Signed and Sealed this
Nineteenth Day of November, 2013

Teresa Stanek Rea
*Deputy Director of the United States Patent and Trademark Office*